US010818234B2

(12) United States Patent
Song et al.

(10) Patent No.: US 10,818,234 B2
(45) Date of Patent: Oct. 27, 2020

(54) CURRENT SENSING DEVICE AND ORGANIC LIGHT EMITTING DISPLAY DEVICE INCLUDING THE SAME

(71) Applicant: LG Display Co., Ltd., Seoul (KR)

(72) Inventors: Eunji Song, Paju-si (KR); Kimin Son, Daegu (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/583,011

(22) Filed: Sep. 25, 2019

(65) Prior Publication Data

US 2020/0105195 A1 Apr. 2, 2020

(30) Foreign Application Priority Data

Sep. 28, 2018 (KR) ..... 10-2018-0116352

(51) Int. Cl.
*G09G 3/3241* (2016.01)
*G09G 3/3291* (2016.01)

(52) U.S. Cl.
CPC ..... *G09G 3/3241* (2013.01); *G09G 3/3291* (2013.01); *G09G 2320/0233* (2013.01); *G09G 2320/0295* (2013.01)

(58) Field of Classification Search
CPC ..... G09G 3/3241; G09G 3/3291; G09G 2320/0295; G09G 2320/0233
See application file for complete search history.

(56) References Cited

U.S. PATENT DOCUMENTS

2013/0235017 A1* 9/2013 Park ..... G09G 3/3208 345/212
2015/0029171 A1* 1/2015 Jo ..... G09G 3/3233 345/212
2015/0221249 A1* 8/2015 Kim ..... G09G 3/3413 345/212
2016/0163261 A1* 6/2016 Kim ..... G09G 3/3225 345/205
2016/0365070 A1* 12/2016 Park ..... G09G 3/3648
2017/0053590 A1* 2/2017 Song ..... G09G 3/3225
2017/0277931 A1* 9/2017 Uehara ..... G06K 9/209

FOREIGN PATENT DOCUMENTS

GB 2530116 A 3/2016
KR 10-2017-0123388 A 11/2017

* cited by examiner

*Primary Examiner* — Carolyn R Edwards
(74) *Attorney, Agent, or Firm* — Seed IP Law Group LLP

(57) ABSTRACT

A current sensing device and an organic light emitting display device including the same are disclosed. The current sensing device includes a sensing unit selectively connected to a pixel and a reference current source through a sensing line. The sensing unit includes a plurality of resistors connected to a first node and setting a divided voltage according to a pixel current input from the pixel and a reference current input from the reference current source, a first MOS transistor connected between the first node and a second node, a second MOS transistor diode-connected to the second node, and a comparator having an inverting input terminal connected to a third node, a non-inverting input terminal connected to a fourth node, comparing a reference voltage charged at the third node when the reference current is input and a pixel voltage charged at the fourth node when the pixel current is input, and outputting a comparison result.

14 Claims, 16 Drawing Sheets

H : Ipix > Iref
L : Ipix < Iref

FIG. 7

| SENSING VALUE (P1, P2, P3) | COMPENSATION VALUE | |
|---|---|---|
| | $\Phi'$ | $\alpha'$ |
| (L, L. H) | $+2 \times \Phi_{LSB}$ | $-\alpha_{LSB}$ |
| (H, H, L) | $-2 \times \Phi_{LSB}$ | $+\alpha_{LSB}$ |
| (L, H, H) | $+\Phi_{LSB}$ | $-2 \cdot \alpha_{LSB}$ |
| (H, L, L) | $-\Phi_{LSB}$ | $+2 \cdot \alpha_{LSB}$ |
| (H, H, H) | $-\Phi_{LSB}$ | 0 |
| (L, L, L) | $+\Phi_{LSB}$ | 0 |

CURRENT SENSING DEVICE AND ORGANIC LIGHT EMITTING DISPLAY DEVICE INCLUDING THE SAME

BACKGROUND

Technical Field

The present document relates to an organic light emitting display device, and more particularly, to a current sensing device and an organic light emitting display device including the same.

Description of the Related Art

An active matrix type organic light emitting display device includes a self-luminous organic light emitting diode (OLED), has a high response speed, has high luminous efficiency and brightness, and has a wide viewing angle.

An organic light emitting display device includes pixels arranged in a matrix form, each pixel including an OLED and regulates brightness of the pixels according to gray scales of image data. The pixels each include a driving element, e.g., a driving thin film transistor (TFT), for controlling a driving current flowing in the OLED according to voltages applied between a gate electrode and a source electrode. Driving characteristics of the OLED and the driving TFT are changed due to a temperature or deterioration. If the driving characteristics of the OLED and/or the driving TFT in each pixel are changed, brightness of pixels is changed although the same image data is written, and thus, it is difficult to realize a desired image.

An external compensation technique is known to compensate for a change in driving characteristics of the OLED or the driving TFT. The external compensation technique is to sense a change in driving characteristic of the OLED or the driving TFT and modulates image data on the basis of sensing results.

BRIEF SUMMARY

An organic light emitting display device uses a current integrator to sense a change in driving characteristics of an OLED or a driving TFT. Since the current integrator is to be connected to every sensing channel, the organic light emitting display device may include a plurality of current integrators. The current integrators may sense a low current but are vulnerable to noise and has a long sensing time. Noise comes from a change in a reference voltage applied to a non-inverting input terminal of the current integrator and a noise source difference between sensing lines connected to an inverting input terminal of the current integrator. Such noise is amplified in the current integrator and reflected in an integral value, potentially distorting sensing results. When sensing performance is lowered, driving characteristics of the OLED or the driving TFT cannot be compensated correctly.

The present disclosure provides a current sensing device which is resistant to noise and capable of reducing a sensing time, and an organic light emitting display device including the same.

In an aspect, a current sensing device includes a sensing unit selectively connected to a pixel and a reference current source through a sensing line. The sensing unit includes a plurality of resistors connected to a first node and setting a divided voltage on the first node according to a pixel current input from the pixel and a reference current input from the reference current source, a first MOS transistor connected between the first node and a second node, a second MOS transistor diode-connected to the second node, and a comparator having an inverting input terminal connected to a third node, a non-inverting input terminal connected to a fourth node, comparing a reference voltage charged at the third node when the reference current is input and a pixel voltage charged at the fourth node when the pixel current is input, and outputting a comparison result.

BRIEF DESCRIPTION OF THE SEVERAL VIEWS OF THE DRAWINGS

FIGS. 5 to 7 illustrate an example of a method of compensating for image data based on sensing results.

DETAILED DESCRIPTION

Figure 1:
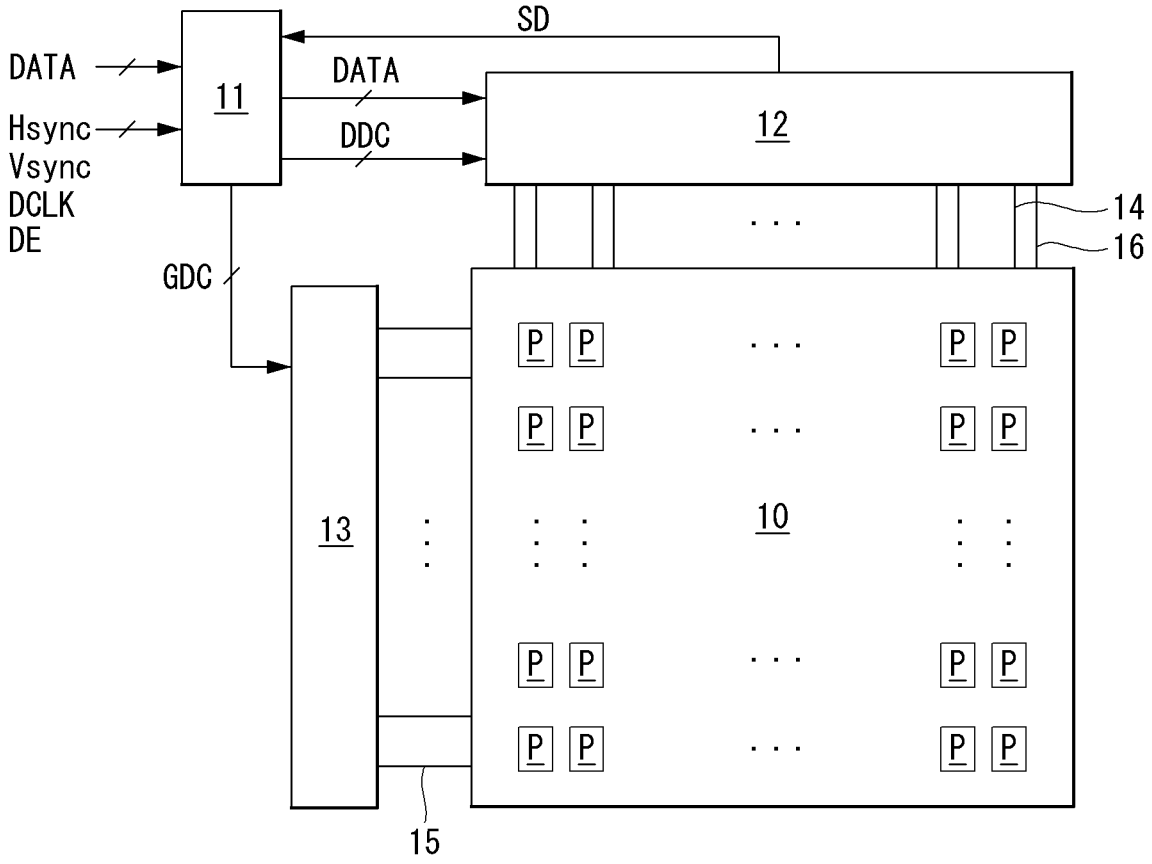
FIG. 1 is a view illustrating an organic light emitting display device according to an embodiment of the present disclosure.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

The shapes, sizes, ratios, angles, numbers and the like disclosed in the drawings for describing the embodiments of the present disclosure are illustrative and are not limited to those illustrated in the present specification. Further, in the description of the present specification, detailed description of known related arts will be omitted if it is determined that the gist of the present specification may be unnecessarily obscured.

In construing an element, the element is construed as including an error range although there is no explicit description.

In describing a position relationship, for example, when two portions are described as "~on", "~above", "~below", or "~on the side", one or more other portions may be positioned between the two portions unless "immediately" or "directly" is used.

It will be understood that, although the terms "first", "second", etc., may be used herein to describe various elements, these elements should not be limited by these terms. These terms are only used to distinguish one element from another. For example, a first element could be termed a second element, and, similarly, a second element could be termed a first element, without departing from the scope of the present disclosure.

Same reference numerals refer to same elements throughout the specification.

In this disclosure, a pixel circuit and a gate driver formed on a substrate of a display panel may be realized as a thin film transistor (TFT) having an n-type metal oxide semiconductor field effect transistor (MOSFET) structure, but without being limited thereto, the pixel circuit and a gate driver may also be realized as a TFT having a p-type MOSFET structure. A TFT is a three-electrode element including a gate, a source, and a drain. The source is an electrode that supplies a carrier to a transistor. In the TFT, carriers start to flow from the source. The drain is an electrode through which the carriers exit from the TFT. That is, in the MOSFET, the carriers flow from the source to the drain. In the case of the n-type TFT, the carriers are electrons, and thus, a source voltage has a voltage lower than a drain voltage so that electrons may flow from the source to the drain. In the n-type TFT, electrons flow from the source to the drain, and thus, current flows from the drain to the source. In contrast, in the case of a p-type TFT (PMOS), since carriers are holes, a source voltage is higher than a drain voltage so that holes may flow from the source to the drain. In the p-type TFT, since holes flow from the source to the drain, current flows from the source to the drain. It should be noted that the source and the drain of the MOSFET are not fixed. For example, the source and the drain of the MOSFET may be changed depending on the applied voltage. Therefore, in the description of the embodiments, one of the source and the drain is referred to as a first electrode and the other is referred to as a second electrode.

Hereinafter, embodiments of the present disclosure will be described in detail with reference to the accompanying drawings. In the following embodiments, an organic light emitting display device including an organic luminescent material will mainly be described as a display device. However, it should be noted that the technical idea of the present disclosure is not limited to the organic light emitting display device but may be applied to an inorganic light emitting display device including an inorganic luminescent material.

In describing the present disclosure, if a detailed description for a related known function or construction is considered to unnecessarily divert the gist of the present disclosure, such explanation has been omitted but would be understood by those skilled in the art.

Figure 2:
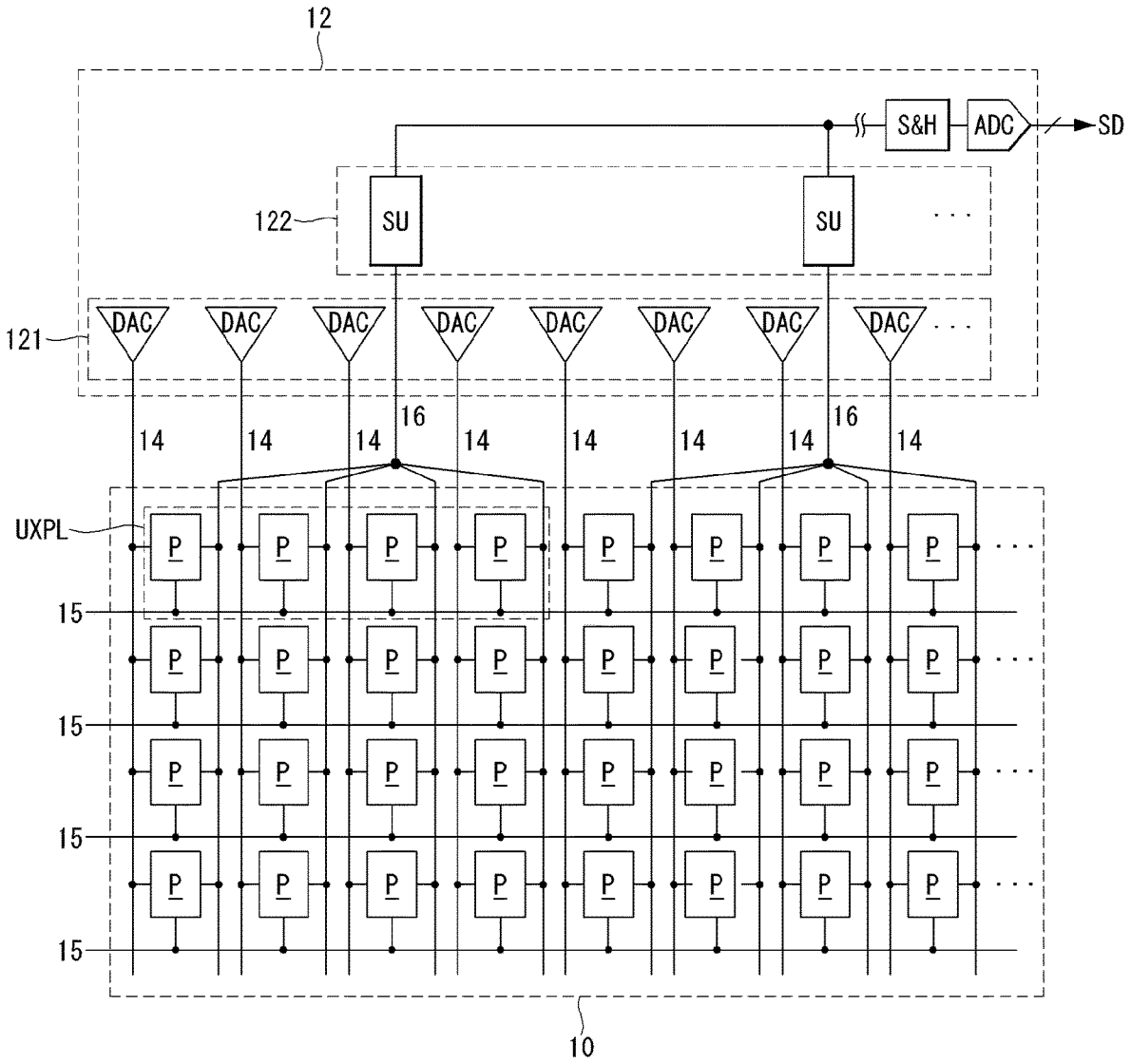
FIG. 2 is a view illustrating a connection structure of a data driver including a current sensing device and a pixel array according to the present disclosure.
Figure 3:
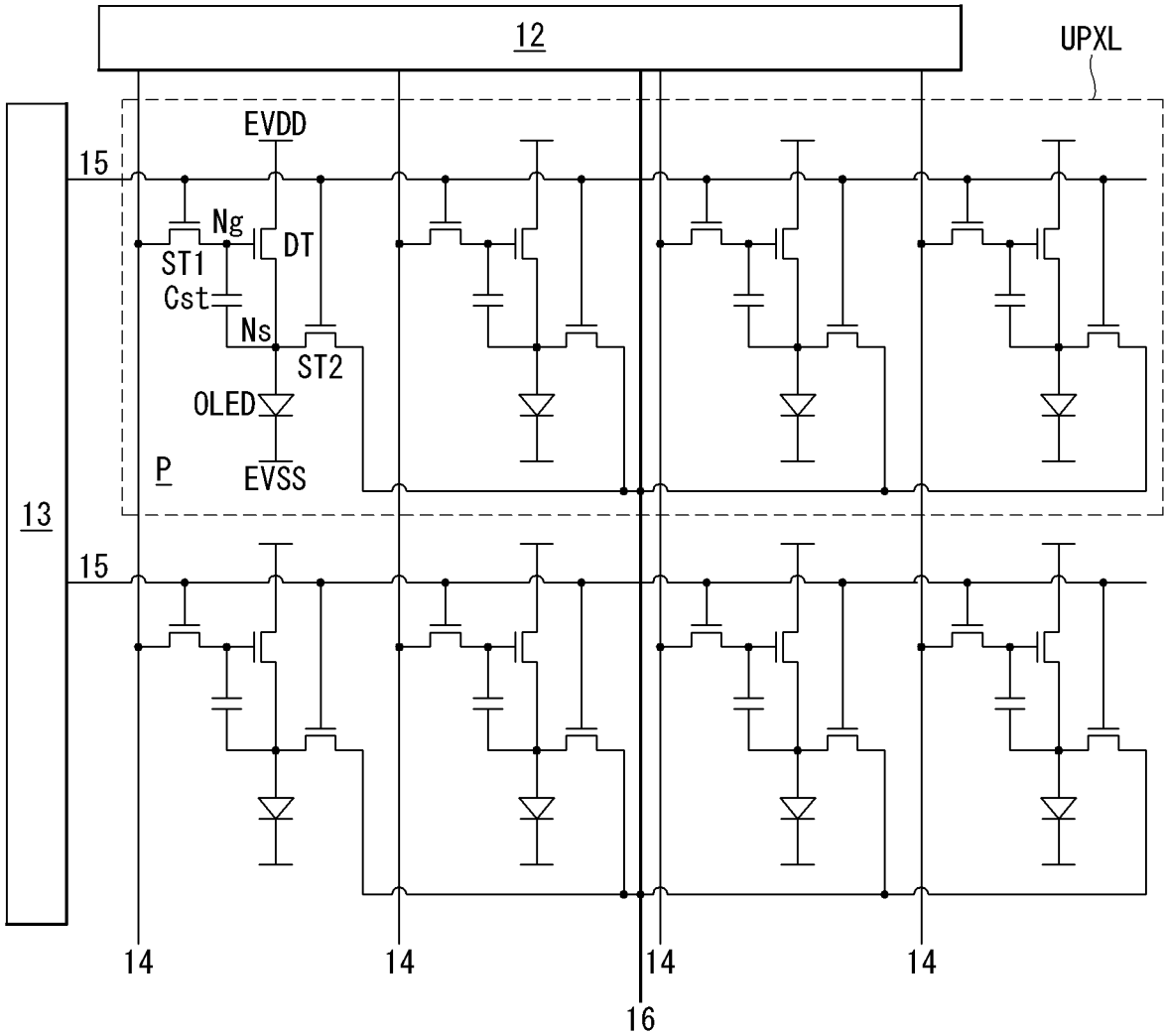
FIG. 3 is a view illustrating a connection configuration of pixels constituting a pixel array.
Figure 4:
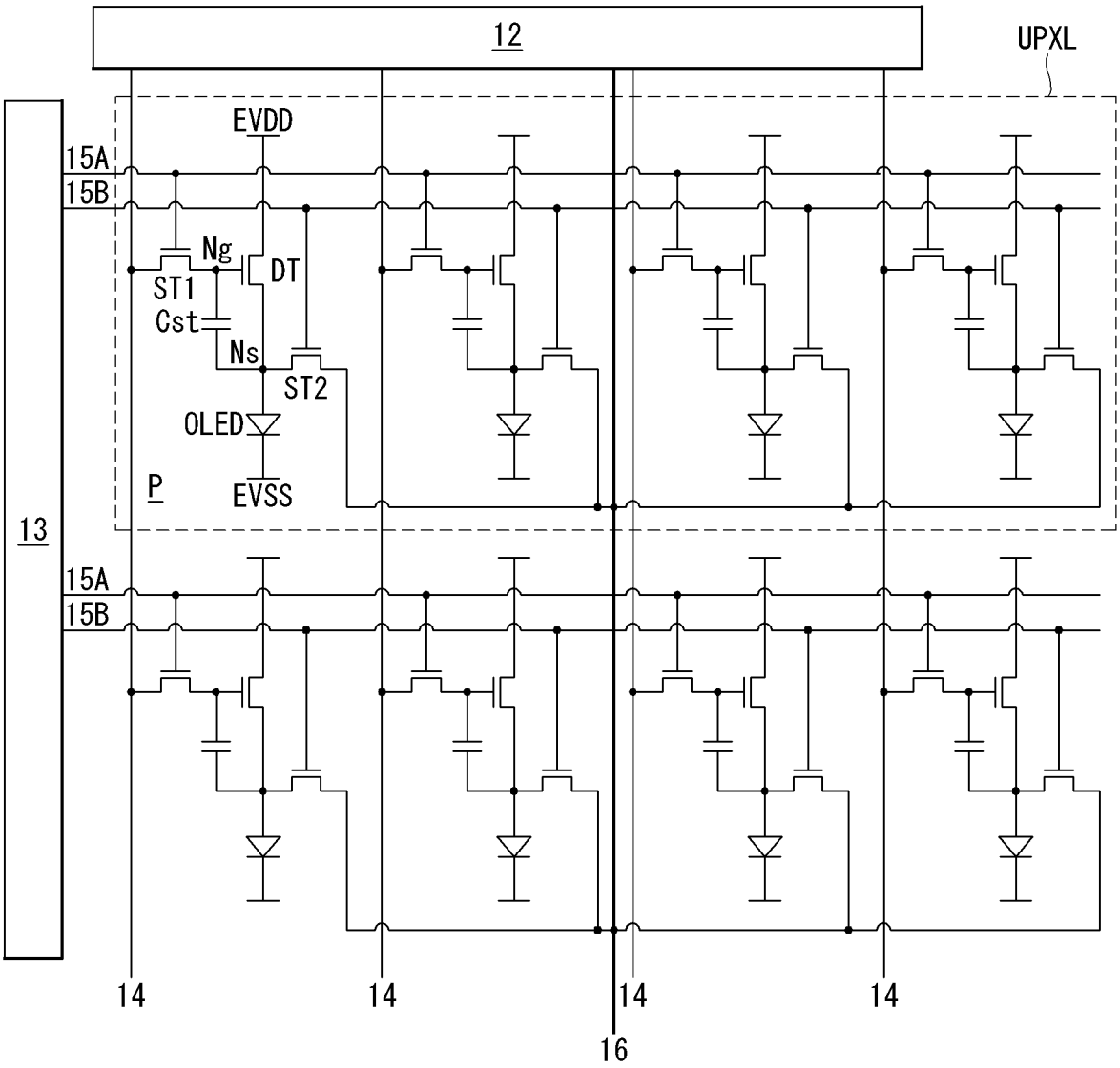
FIG. 4 is a view illustrating another connection configuration of pixels constituting a pixel array.

FIG. 1 is a view illustrating an organic light emitting display device according to an embodiment of the present disclosure. FIG. 2 is a view illustrating a connection structure of a data driver including current sensing circuitry, which will be referred to as a current sensing device in the following description, and a pixel array according to the present disclosure. FIGS. 3 and 4 are views illustrating connection configurations of pixels constituting a pixel array.

Referring to FIGS. 1 to 4, an organic light emitting display device according to an embodiment of the present disclosure includes a display panel 10, a timing controller 11, a data driver 12, and a gate driver 13. The data driver 12 includes a current sensing device according to an embodiment of the present disclosure.

In the display panel 10, a plurality of data lines 14 and sensing lines 16 and a plurality of gate lines 15 intersect each other and sensing pixels P are arranged in a matrix at the intersections to form a pixel array. The gate lines 15 may include a plurality of first gate lines 15A to which a scan control signal SCAN is supplied and a plurality of second gate lines 15B to which a sensing control signal SEN is supplied, (15B). However, when the scan control signal SCAN and the sensing control signal SEN are in phase, the first and second gate lines 15A and 15B may be unified into one gate line 15 as illustrated in FIG. 3.

Each pixel P may be connected to any one of the data lines 14, to any one of the sensing lines 16, and to any one of the gate lines 15. The pixels P constituting the pixel array may include a red pixel for representing red, a green pixel for representing green, a blue pixel for representing blue, and a white pixel for representing white. Four pixels including a red pixel, a green pixel, a blue pixel, and a white pixel may constitute one pixel unit UPXL. However, the configuration of the pixel unit UPXL is not limited thereto. The plurality of pixels P constituting the same pixel unit UPXL may share one sensing line 16. However, although not shown, a plurality of pixels P constituting the same pixel unit UPXL may be independently connected to different sensing lines. Each of the pixels P is supplied with a high potential pixel voltage EVDD and a low potential pixel voltage EVSS from a power supply unit (not shown).

As illustrated in FIGS. 3 and 4, the pixel P of the present disclosure includes an OLED, a driving TFT DT, a storage capacitor Cst, a first switch TFT ST1, and a second switch TFT ST2 but is not limited thereto. The TFTs may be implemented as a P type, an N type, or a hybrid type in which the P type and the N type are combined. Further, a semiconductor layer of the TFT may include amorphous silicon, polysilicon, or an oxide.

The OLED includes an anode electrode connected to a source node Ns, a cathode electrode connected to an input terminal of the low-potential pixel voltage EVSS, and an organic compound layer positioned between the anode electrode and the cathode electrode. The organic compound layer includes a hole injection layer (HIL), a hole transport layer (HTL), an emission layer (EML), an electron transport layer (ETL), and an electron injection layer (EIL).

The driving TFT DT controls the magnitude of a source-drain current Ids of the driving TFT DT input to the OLED according to a gate-source voltage Vgs. The driving TFT DT has a gate electrode connected to a gate node Ng, a drain electrode connected to an input terminal of the high potential pixel voltage EVDD, and a source electrode connected to a source node Ns. The storage capacitor Cst is connected between the gate node Ng and the source node Ns to maintain the Vgs of the driving TFT DT for a predetermined period of time. The first switch TFT ST1 switches electrical connection between the data line 14 and the gate node Ng according to a scan control signal SCAN. The first switch TFT ST1 has a gate electrode connected to the first gate line 15A, a first electrode connected to the data line 14, and a second electrode connected to the gate node Ng. The second switch TFT ST2 switches electrical connection between the source node Ns and the sensing line 16 according to the sensing control signal SEN. The second switch TFT ST2 has a gate electrode connected to the second gate line 15B, a first electrode connected to the sensing line 16, and a second electrode connected to the source node Ns.

The first gate line 15A and the second gate line 15B may be unified into one gate line 15 (see FIG. 3). In this case, the scan control signal SCAN and the sensing control signal SEN may be in phase.

The organic light emitting display device having such a pixel array employs an external compensation technique. The external compensation technique is a technique of sensing driving characteristics of an organic light emitting diode (OLED) and/or a driving TFT (Thin Film Transistor) provided in the pixels and correcting input image data according to the sensing value. The driving characteristics of the OLED refers to an operating point voltage of the OLED. The driving characteristics of the driving TFT refers to a threshold voltage of the driving TFT and electron mobility of the driving TFT.

The organic light emitting display device of the present disclosure performs an image display operation and an external compensation operation. The external compensation operation may be performed during a vertical blanking period while the image display operation is performed, during a power on sequence period before image displaying starts, or during a power off sequence period after image displaying terminates. The vertical blanking period is a period during which no video data is written, which is arranged between vertical active periods during which video data for one frame is written. The power on sequence period refers to a period from a point in time at which driving power is turned on until to a point in time at which an image is displayed. The power off sequence period refers to a period from a point in time at which image displaying terminates to a point in time at which the driving power is turned off.

The timing controller 11 generates a data control signal DDC for controlling an operation timing of the data driver 12 and a gate control signal GDC for controlling an operation timing of the gate driver 13 on the basis of timing signals such as a vertical synchronization signal Vsync, a horizontal synchronization signal Hsync, a dot clock signal DCLK, a data enable signal DE, and the like. The timing controller 11 may temporally separate a period during which image displaying is performed and a period during which external compensation is performed and generate the control signals DDC and GDC for image displaying and the control signals DDC and GDC for external compensation to be different.

The gate control signal GDC includes a gate start pulse GSP, a gate shift clock GSC, and the like. The gate start pulse GSP is applied to a gate stage that generates a first scan signal to control the gate stage to generate a first scan signal. The gate shift clock GSC is a clock signal input in common to gate stages and is a clock signal for shifting the gate start pulse GSP.

The data control signal DDC includes a source start pulse SSP, a source sampling clock SSC, and a source output enable signal SOE. The source start pulse SSP controls a data sampling start timing of the data driver 12. The source sampling clock SSC is a clock signal that controls a sampling timing of data in each source drive IC on the basis of a rising or falling edge. The source output enable signal SOE controls an output timing of the data driver 12. The data control signal DDC includes general signals for controlling an operation of the current sensing device included in the data driver 12.

The timing controller 11 receives a digital sensing value SD according to the external compensation operation from the data driver 12. The timing controller 11 may correct input image data DATA on the basis of the digital sensing value SD to compensate for degradation variations of the driving TFTs of the pixels P or degradation variations of OLEDs of the pixels P. The timing controller 11 transmits the corrected digital image data DATA to the data driver 12 during an operation period for displaying an image.

The data driver 12 includes at least one source driver integrated circuit (IC). The source driver IC includes a latch array (not shown), a plurality of digital-to-analog converters (DACs) 121 respectively connected to the data lines 14, and a current sensing device connected to each sensing line 16 through a sensing channel. The current sensing device includes a plurality of sensing circuits, which will be referred to as sensing units SU 122 in following description, a sample-and-hold circuit S&H, and an analog-to-digital converter (ADC).

The latch array latches the digital image data DATA input from the timing controller 11 on the basis of the data control signal DDC, and supplies the latched digital image data DATA to the DAC. The DAC may convert the digital image data DATA input from the timing controller 11 into a data voltage for image display and supply the converted data voltage to the data lines 14 in case of the image display operation. The DAC may generate a data voltage for sensing at a certain level and supply the generated data voltage to the data lines 14 in case of the external compensation operation.

The sensing units SU each compare a pixel current input through the sensing line 16 with a reference current and output a comparison result. The sensing units SU may each employ a comparator, instead of an existing current integrator, which is resistant to noise and reduces a sensing time. In case of the related art current integrator, noise amplification due to a feedback capacitor is a problem. A high resolution and high-definition display device has a very small pixel current, and thus, in order to set a sensing time and an output voltage to be constant, capacity of a feedback capacitor is to be small. Thus, noise mixed in a reference voltage of the current integrator is inevitably amplified according to a capacitance ratio between the feedback capacitor and a parasitic capacitor existing in the sensing line. Because of the amplified noise, the pixel current cannot be accurately sensed.

Figure 11:
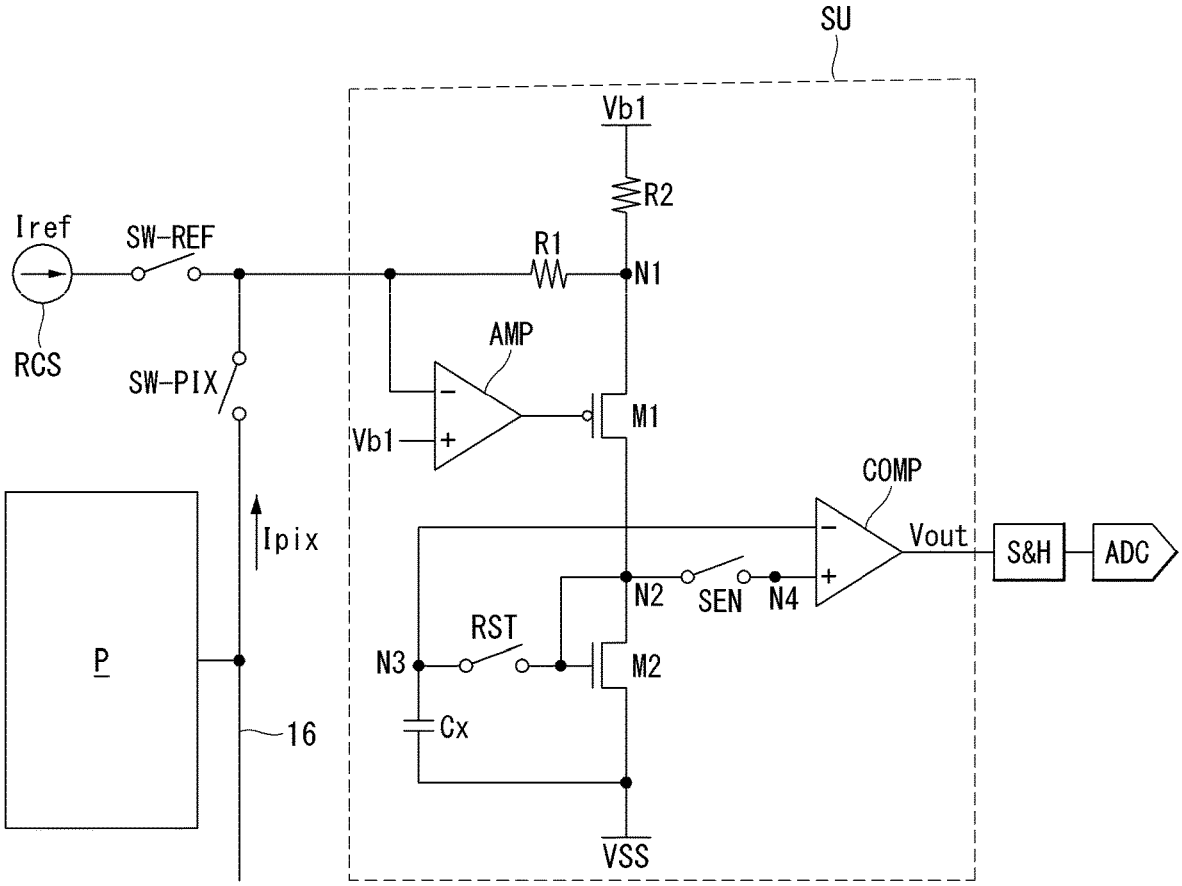
FIG. 11 is a view illustrating a configuration of a sensing unit included in a current sensing device according to an embodiment of the present disclosure.

Each of the sensing units SU may include two MOS transistors, two amplifiers, two resistors, a capacitor, and the like, as illustrated in FIG. 11. Each of the sensing units SU may operate a diode-connected MOS transistor only in a saturation region and make a voltage variation with respect to a current variation constant, thereby further improving resolution and accuracy of sensing.

The sample-and-hold circuit S&H samples sensing results from the sensing units SU and delivers the sampled sensing results to an ADC. The ADC serves to convert the sensing results of the sensing units SU into a digital sensing value SD.

The gate driver 13 generates a scan control signal SCAN according to the image display operation and the external compensation operation on the basis of the gate control signal GDC and then supplies the scan control signal SCAN to the first gate lines 15A. The gate driver 13 generates a sensing control signal SEN according to the image display operation and the external compensation operation on the basis of the gate control signal GDC and then supplies the sensing control signal SEN to the second gate lines 15B. The gate driver 13 may generate a scan control signal SCAN and a sensing control signal SEN in phase according to the image display operation and the external compensation operation on the basis of the gate control signal GDC and supply the generated scan control signal SCAN and the sensing control signal SEN to the gate lines 15.

Figure 5:
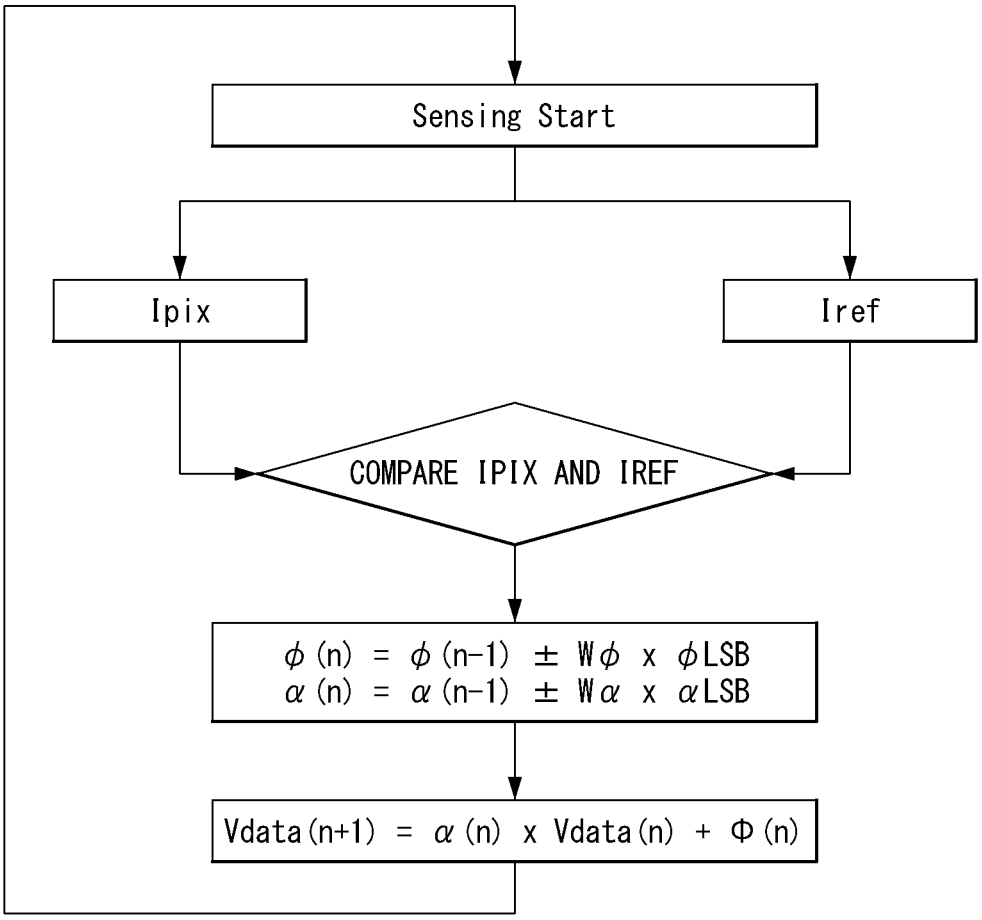
Figure 6:
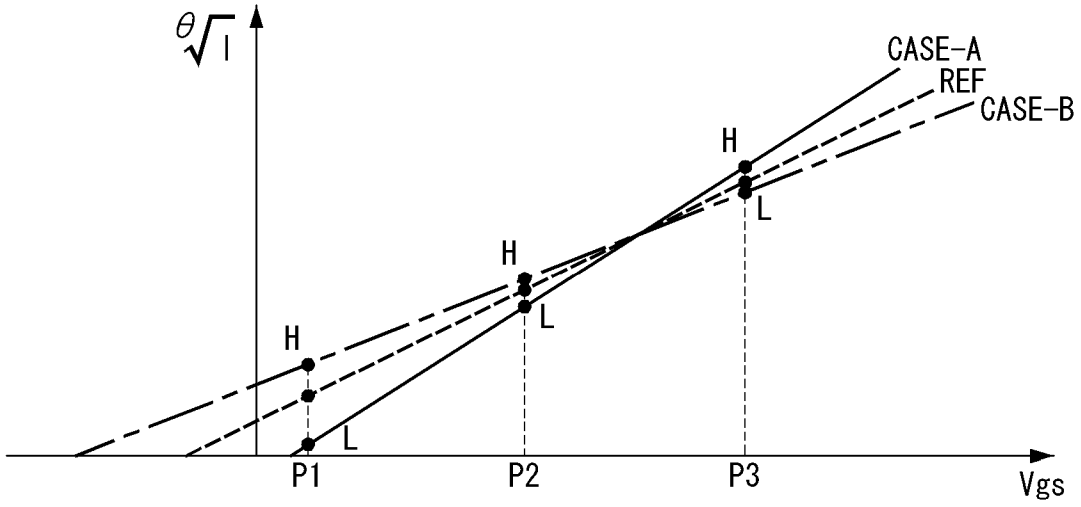

FIGS. 5 to 7 illustrate an example of a method of compensating for image data based on sensing results.

Referring to FIGS. 5 to 7, the sensing unit SU of the present disclosure compares a pixel current Ipix input through the sensing line 16 with a reference current Iref and outputs a comparison result. The timing controller 11 then updates data compensation parameters (Φ,α) on the basis of the comparison result and applies the updated data compensation parameters (Φ,α) to a compensation equation to correct the digital image data. The compensation parameter Φ is a parameter for compensating for a change in threshold voltage of the driving TFT included in the pixel, and the compensation parameter α is a parameter for compensating for a change in electron mobility of the driving TFT. In FIGS. 5 to 7, 'ΦLSB' and 'αLSB' represent a minimum compensation unit designated by the number of bits in the IC. 'WΦ' is a weight multiplied to the compensation parameter Φ, and 'Wα' represents a weight multiplied to the compensation parameter α.

The timing controller 11 of the present disclosure corrects the digital image data such that the pixel current Ipix is equal to the reference current Iref. The timing controller 11 may use at least three sensing values P1, P2, and P3 for each pixel P, thus assigning an accurate weight and enhance compensation performance. If the pixel current Ipix is greater than the reference current Iref, the timing controller 11 recognizes it as a first logic value H, and if the pixel current Ipix is smaller than the reference current Iref, the timing controller 11 recognizes it as a second logic value L. By assigning logic values for the three sensing values P1, P2, and P3, respectively, a compensation value for converging to the reference current corresponding graph may be derived as illustrated in FIGS. 6 and 7.

Figure 8:
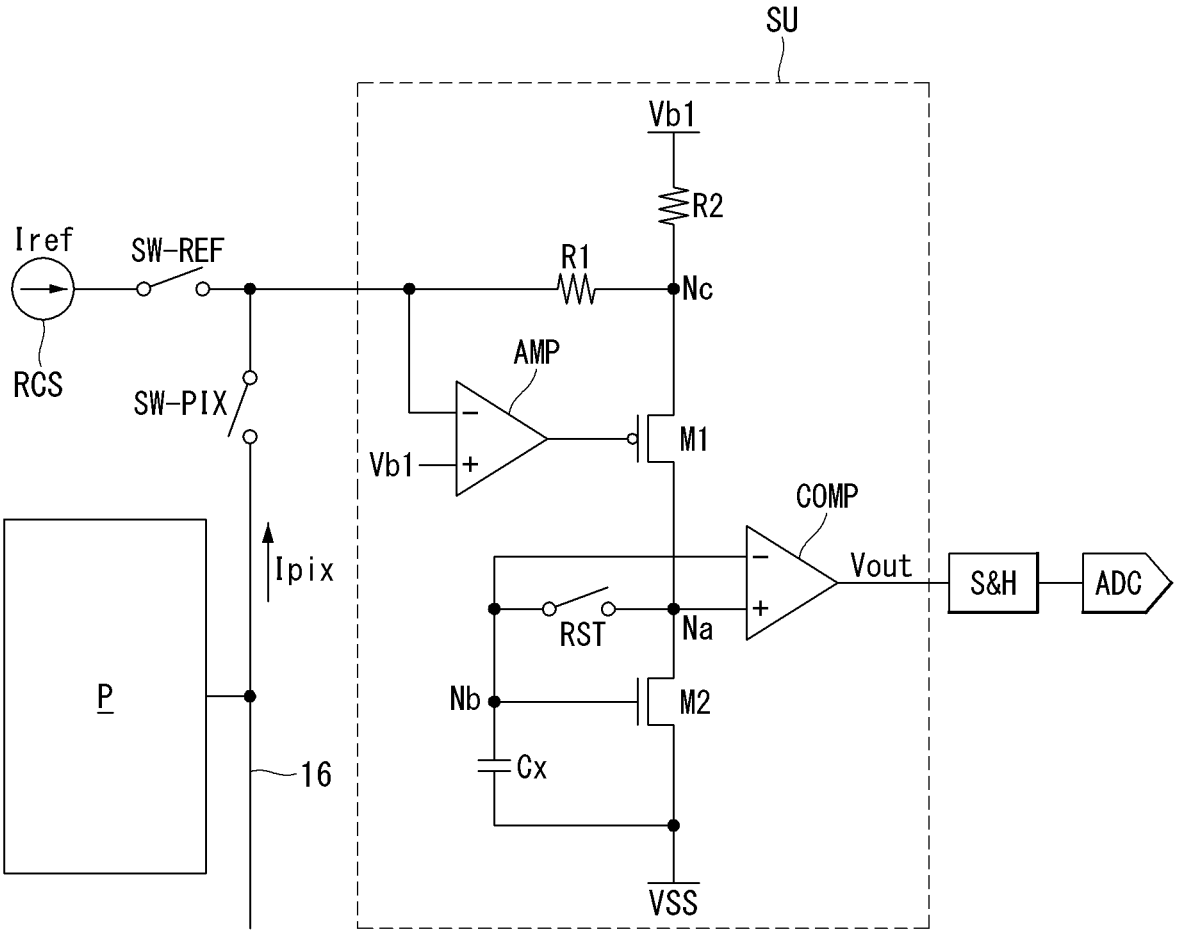
FIG. 8 is a view illustrating a configuration of a sensing unit included in a current sensing device according to a comparative example.
Figure 9:
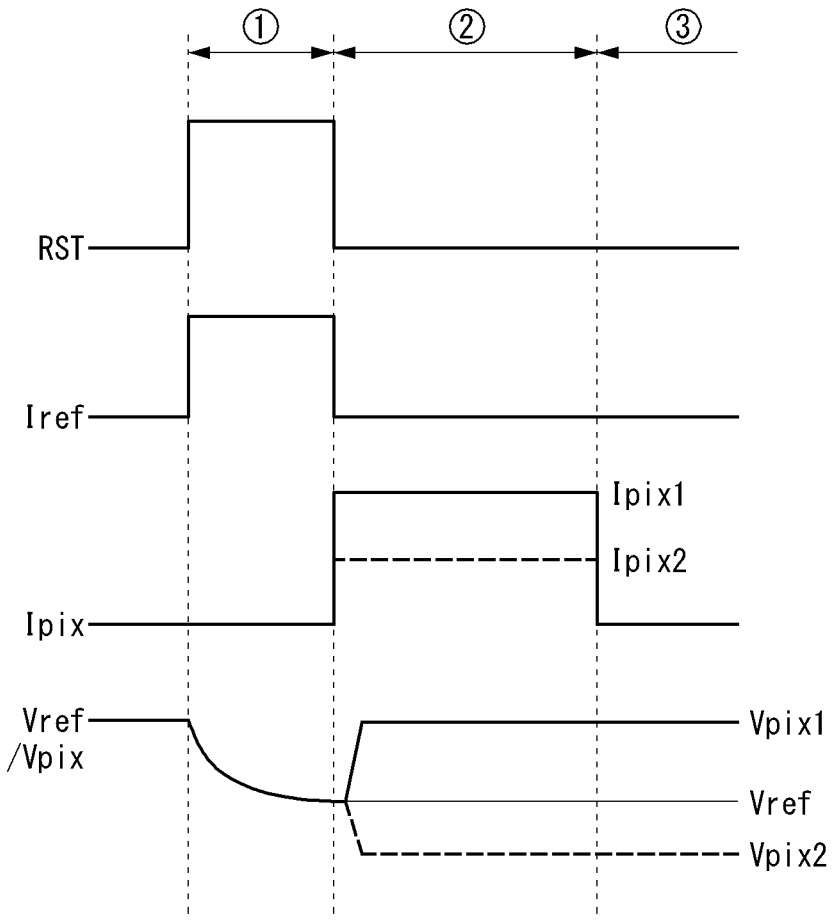
FIG. 9 is an operational waveform view of the sensing unit of FIG. 8.
Figure 10:
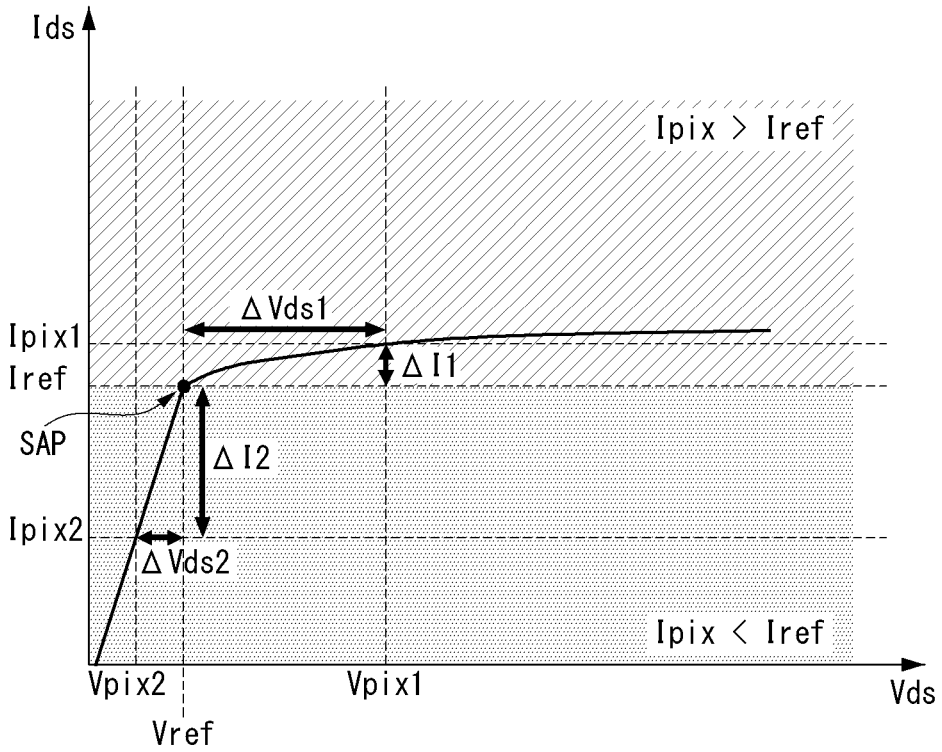
FIG. 10 is a view illustrating an output waveform of a second MOS transistor included in the sensing unit of FIG. 8.

FIG. 8 is a view illustrating a configuration of a sensing unit included in a current sensing device according to a comparative example of the present disclosure. FIG. 9 is an operational waveform view of the sensing unit of FIG. 8. FIG. 10 is a view illustrating an output waveform of a second MOS transistor included in the sensing unit of FIG. 8.

Referring to FIG. 8, the sensing unit SU according to a comparative example includes an operational amplifier AMP, a first MOS transistor M1, a second MOS transistor M2, a comparator COMP, first and second resistor R1, R2, a capacitor Cx, and a reset switch RST.

The sensing unit SU is selectively connected to a reference current source RCS and the pixel P and receives the reference current Iref and the pixel current Ipix alternately. To this end, a first connection switch SW-REF may be connected between the sensing unit SU and the reference current source RCS, and a second connection switch SW-PIX may be connected between the sensing unit SU and the pixel P. The first connection switch SW-REF and the second connection switch SW-PIX are alternately turned on selectively.

Referring to FIGS. 8 and 9, during am initialization period ①, the first connection switch SW-REF is turned on and the reference current Iref is input to the sensing unit SU. A specific voltage is set to a node Nc of the sensing unit SU, and a source-drain current flows between a first MOS transistor M1 and a second MOS transistor M2. Here, when the reset switch RST is turned on, the reference voltage Vref based on the reference current Iref is set to a node Nb.

Referring to FIGS. 8 and 9, during a sensing period ②, the second connection switch SW-PIX is turned on and the pixel current Ipix is input to the sensing unit SU. Then, a specific voltage is set to the node Nc of the sensing unit SU and a source-drain current flows between the first MOS transistor M1 and the second MOS transistor M2. Here, when the reset switch RST is turned off, the pixel voltage Vpix based on the pixel current Ipix is set to the node Na. Then, the comparator COMP compares the pixel voltage Vpix with the reference voltage Vref and outputs a comparison result Vout to the sample-and-hold circuit S&H.

Referring to FIGS. 8 and 9, during a sampling period ③, the sample-and-hold circuit S&H samples the comparison result Vout and outputs the sampled result to the ADC. The ADC then outputs the sampled result as a digital sensing value SD.

In case of the sensing unit, a current range for the comparator COMP to normally operate is very limited. Specifically, when the pixel current Ipix is larger than the reference current Iref as illustrated in FIG. 10, the second MOS transistor M2 operates in a saturation region, and here, since a voltage variation ΔVds1 is large with respect to a current variation ΔI1, there is not problem. However, when the pixel current Ipix is smaller than the reference current Iref, since the second MOS transistor M2 operates in a linear region, a voltage variation ΔVds2 with respect to a current variation ΔI2 is so small that the comparator COMP is difficult to operate normally. That is, when the pixel current Ipix is smaller than the reference current Iref, if the pixel current Ipix is not sufficiently smaller than the reference current Iref, the comparator COMP may not normally operate.

In FIG. 10, the saturation region and the linear region are divided on the basis of a saturation point SAP corresponding to the reference current Iref. In an output waveform of the second MOS transistor M2 representing a change in the drain-source current Ids based on the drain-source voltage Vds, the saturation region refers to an output region higher than the reference current Iref and the linear region refers to an output region lower than the reference current Iref.

Figure 12:
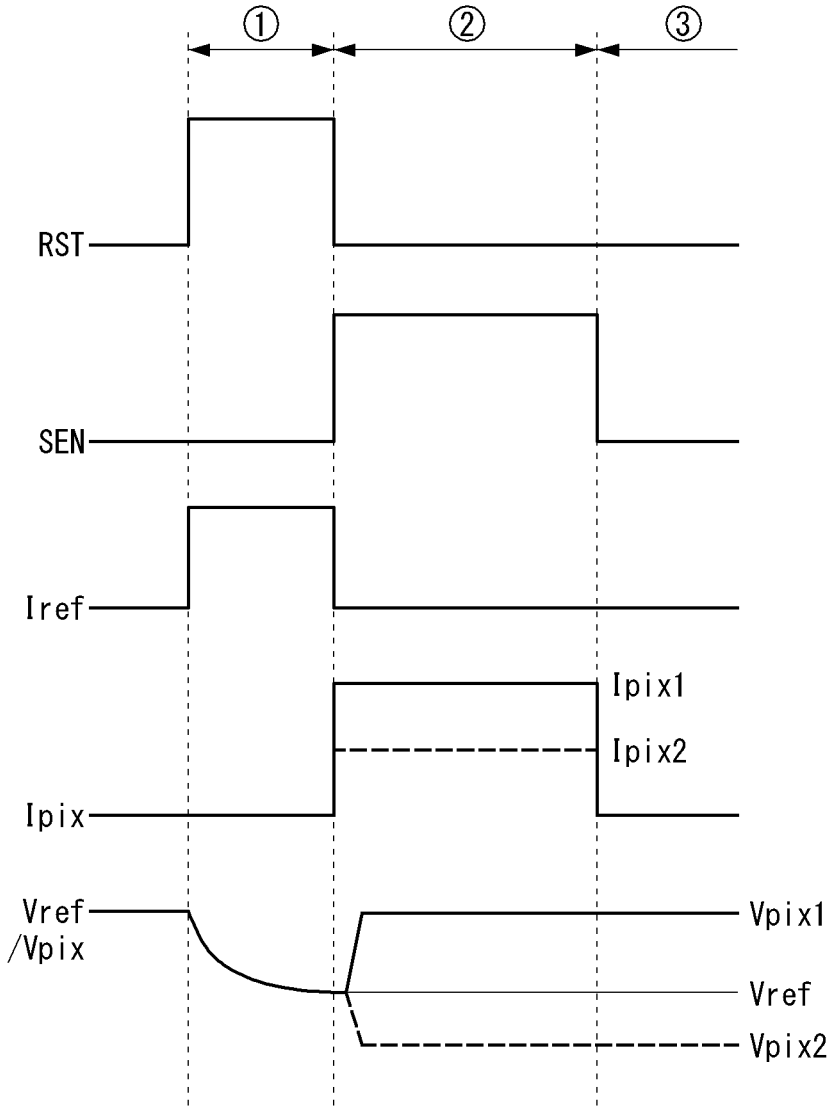
FIG. 12 is an operational waveform view of the sensing unit of FIG. 11.
Figure 13:
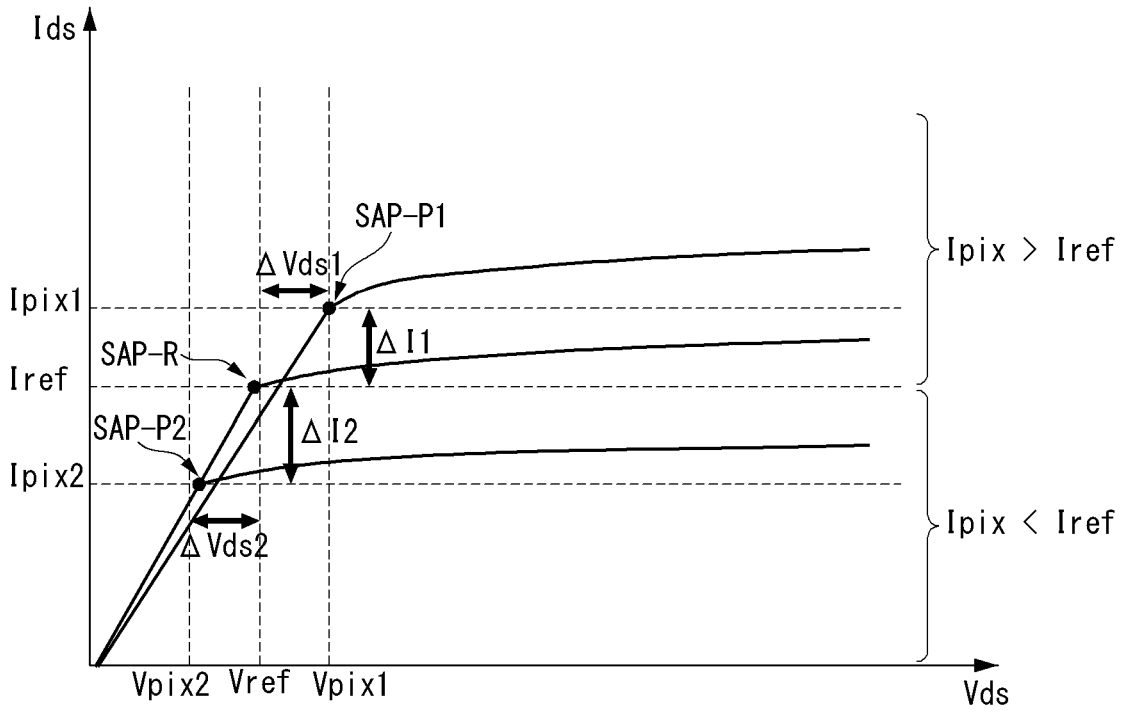
FIG. 13 is a view illustrating an output waveform of a second MOS transistor included in the sensing unit of FIG. 11.
Figure 14:
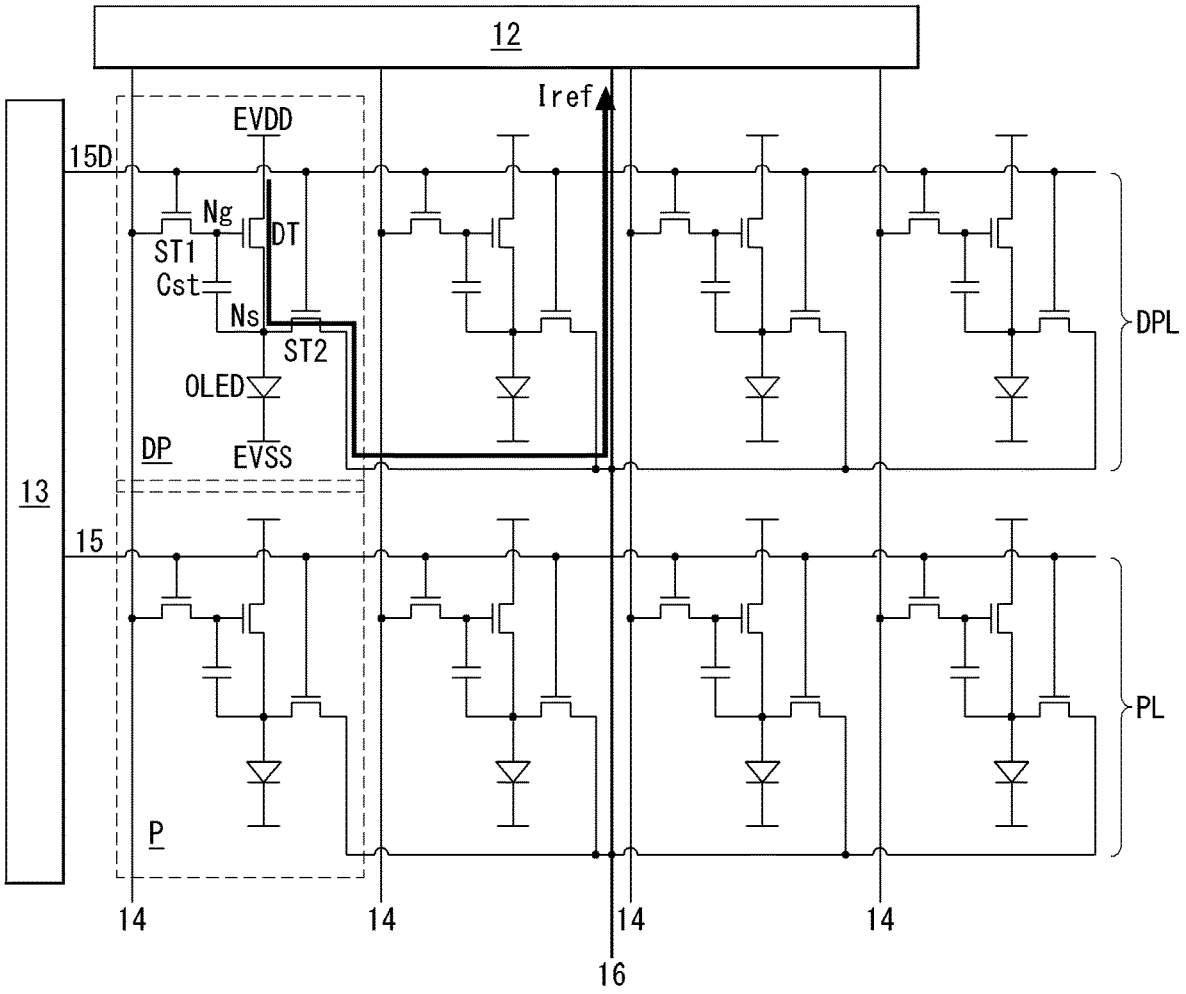
FIG. 14 is a view illustrating an example in which a reference current source is formed by utilizing dummy pixels additionally provided in a pixel array.

FIG. 11 is a view illustrating a configuration of a sensing unit included in the current sensing device according to an embodiment of the present disclosure. FIG. 12 is an operational waveform view of the sensing unit of FIG. 11. FIG. 13 is a view illustrating an output waveform of the second MOS transistor included in the sensing unit of FIG. 11. FIG. 14 is a view illustrating an example in which a reference current source is formed by utilizing dummy pixels additionally provided in a pixel array.

Referring to FIG. 11, a sensing unit SU selectively connected to a pixel P and a reference current source RCS through a sensing line 16 is illustrated. The sensing unit SU according to an embodiment of the present disclosure includes a plurality of resistors R1 and R2, a first MOS transistor M1, a second MOS transistor M2, and a comparator COMP. The sensing unit SU according to an embodiment of the present disclosure may further include a reset switch RST, a sense switch SEN, and a capacitor Cx.

The sensing unit SU according to an embodiment of the present disclosure may further include an operational amplifier AMP for fixing a voltage of the sensing line 16 to a bias voltage Vb1.

The sensing unit SU is selectively connected to the reference current source RCS and the pixel P to selectively receive the reference current Iref and the pixel current Ipix alternately. To this end, a first connection switch SW-REF may be connected between the sensing unit SU and the reference current source RCS, and a second connection switch SW-PIX may be connected between the sensing unit SU and the pixel P. The first connection switch SW-REF and the second connection switch SW-PIX are alternately turned on selectively.

The reference current source RCS may be manufactured as an IC and embedded together with the current sensing device in the data driver 12 or may be implemented through dummy pixels DP to which the digital image data DATA is not written in the display panel 10. An example in which the reference current source RCS is implemented as the dummy pixels DP is illustrated in FIG. 14. In the pixel array of the display panel 10, a dummy pixel block DPL including the dummy pixels DP may be positioned closer to the data driver 12 than a pixel block PL including the pixels P. A configuration of the dummy pixels DP may be designed the same as a configuration of the pixels P, but OLEDs of the dummy pixels DP do not emit light. The dummy pixels DP only serve to generate the reference current Iref. The dummy pixels DP may be connected to the gate driver 13 through a dummy gate line 15D. The gate driver 13 may further generate a dummy gate signal for driving the dummy gate line 15D. Meanwhile, when the reference current source RCS is implemented as the dummy pixels DP, the first connection switch SW-REF and the second connection switch SW-PIX may be omitted.

The plurality of resistors R1 and R2 are connected to the first node N1 and set a divided voltage according to the pixel current Ipix input from the pixel P and the reference current Iref input from the reference current source RCS. The plurality of resistors R1 and R2 include a first resistor R1 connected between the sensing line 16 and the first node N1 and a second resistor R2 connected between the first node N1 and the bias voltage source Vb1.

The first MOS transistor M1 is connected between the first node N1 and the second node N2. A gate electrode of the first MOS transistor M1 is connected to an output terminal of the operational amplifier AMP, a source electrode of the first MOS transistor M1 is connected to the first node N1, and a drain electrode of the first MOS transistor M1 is connected to the second node N2. The first MOS transistor M1 may be implemented as a P type.

The second MOS transistor M2 is diode-connected to the second node N2. A gate electrode and a drain electrode of the second MOS transistor M2 are connected to the second node N2 and a source electrode of the second MOS transistor M2 is connected to a low potential voltage source VSS. The second MOS transistor M2 may be implemented as an N type. Since the second MOS transistor M2 is diode-connected to the second node N2, a gate-source voltage of the second MOS transistor M2 is equal to a drain-source voltage of the second MOS transistor M2. Accordingly, as illustrated in FIG. 13, the second MOS transistor M2 operates only in the saturation region, and a voltage variation ΔVds (ΔVds1, ΔVds2) with respect to a current variation ΔI (ΔI1, ΔI2) is constant in an output waveform of the second MOS transistor M2 representing a change in the drain-source current ΔIds based on the change in the drain-source voltage ΔVds.

In other words, since the second MOS transistor M2 operates in the saturation region even when the pixel current Ipix is smaller than the reference current Iref, as well as when the pixel current Ipix is larger than the reference current Iref as illustrated in FIG. 13, the voltage variation ΔVds with respect to the current variation ΔI is large and the comparator COMP may normally operate. In this manner, when the second MOS transistor M2 is diode-connected to the second node N2, sensing resolution is advantageously increased even when the pixel current Ipix is smaller than the reference current Iref.

In FIG. 13, a first saturation point SAP-P1 is determined to correspond to a first pixel current Ipix1 which is larger than the reference current Iref, a reference saturation point SAP-R is determined to correspond to the reference current Iref, and a second saturation point SAP-P2 is determined to correspond to a second pixel current Ipix2 which is smaller than the reference current Iref. As can be seen from this, even when the second pixel current Ipix2 smaller than the reference current Iref is input, the second MOS transistor M2 operates in an output region higher than the second saturation point SAP-P2, e.g., in the saturation region. Thus, the voltage variation ΔVds with respect to the current variation ΔI may be sufficiently secured so that the comparator COMP may normally operate.

The comparator COMP has an inverting input terminal (−) connected to the third node N3 and a non-inverting input terminal (+) connected to the fourth node N4. The comparator COMP compares the reference voltage Vref charged at the third node N3 when the reference current Iref is input and the pixel voltage Vpix charged at the fourth node N4 when the pixel current Ipix is input, and outputs a comparison result Vout.

The operational amplifier AMP includes an inverting input terminal (−) connected to the sensing line 16, a non-inverting input terminal (+) connected to the bias voltage source Vb1, and an output terminal connected to the gate electrode of the first MOS transistor M1. The operational amplifier AMP serves to stabilize the pixel current Ipix by fixing the voltage of the sensing line 16 to the bias voltage Vb1.

The reset switch RST is connected between the second node N2 and the third node N3 and is turned on only when the reference current Iref is input. The reset switch RST is also connected between the gate electrode of the second MOS transistor M2 and the third node N3.

The sense switch SEN is connected between the second node N2 and the fourth node N4 and is turned on only when the pixel current Ipix is input. The sense switch SEN minimizes an influence of parasitic capacitance when the pixel current Ipix is input, to thus rapidly set the pixel voltage Vpix to the second node N4. In some cases, however, the sense switch SEN may be omitted, and here, the second node N2 and the fourth node N4 become the same node.

The capacitor Cx is connected between the third node N3 and the low potential voltage source VSS and serves to maintain the reference voltage Vref charged at the third node N3.

Referring to FIGS. 11 and 12, during the initialization period ①, the first connection switch SW-REF is turned on and the reference current Iref is input to the sensing unit SU. Then, a specific voltage is set to the first node N1 of the sensing unit SU and a source-drain current flows through the first MOS transistor M1 and the second MOS transistor M2. Here, when the reset switch RST is turned on, the reference voltage Vref based on the reference current Iref is set to the third node N3.

Referring to FIGS. 11 and 12, during the sensing period ②, the second connection switch SW-PIX is turned on and the pixel current Ipix is input to the sensing unit SU. Then, a specific voltage is set to the first node N1 of the sensing unit SU and a source-drain current flows through the first MOS transistor M1 and the second MOS transistor M2. Here, when the reset switch RST is turned off and the sense switch SEN is turned on, the pixel voltage Vpix based on the pixel current Ipix is set to the fourth node N4. Then, the comparator COMP compares the pixel voltage Vpix with the reference voltage Vref and outputs the comparison result Vout to the sample-and-hold circuit S&H.

Referring to FIGS. 11 and 12, during the sampling period ③, the sample-and-hold circuit S&H samples the comparison result Vout and outputs the sampled result to the ADC. Then, the ADC outputs the sampled result as a digital sensing value SD.

Figure 15:
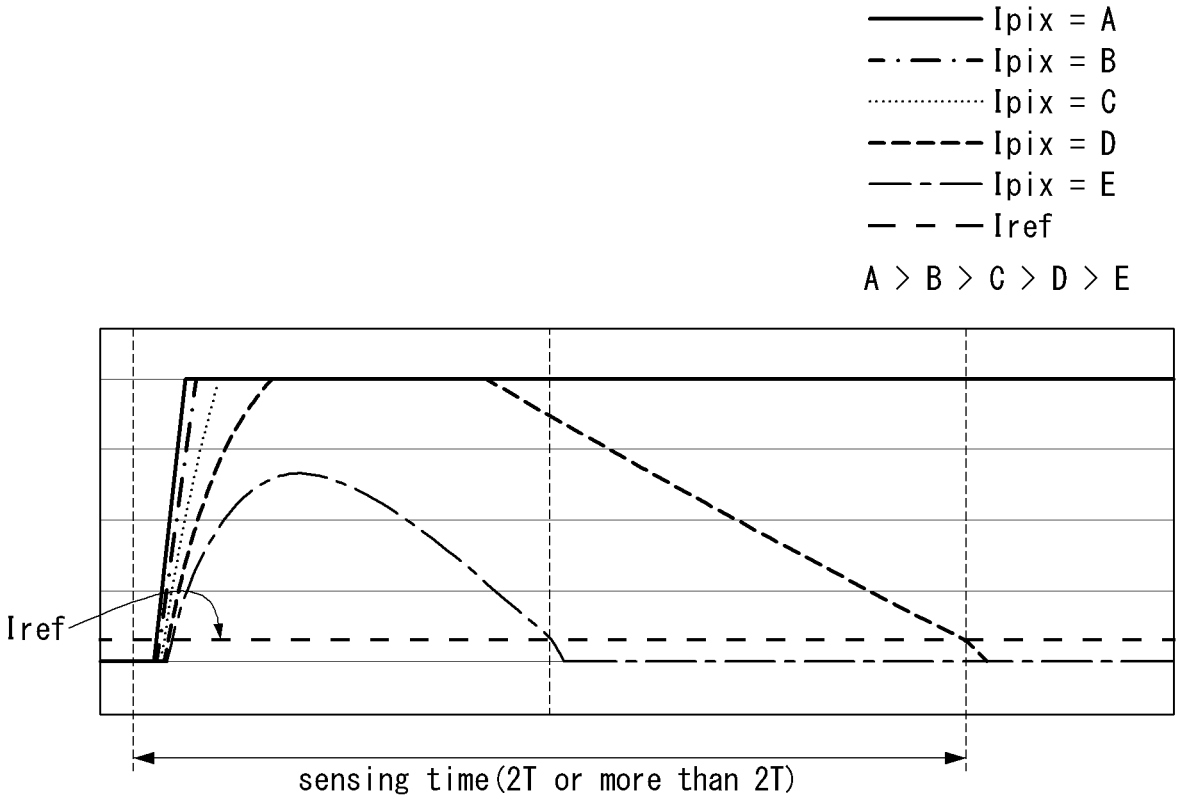
FIG. 15 is a view of a simulation waveform illustrating sensing results according to the sensing unit of FIG. 8.
Figure 16:
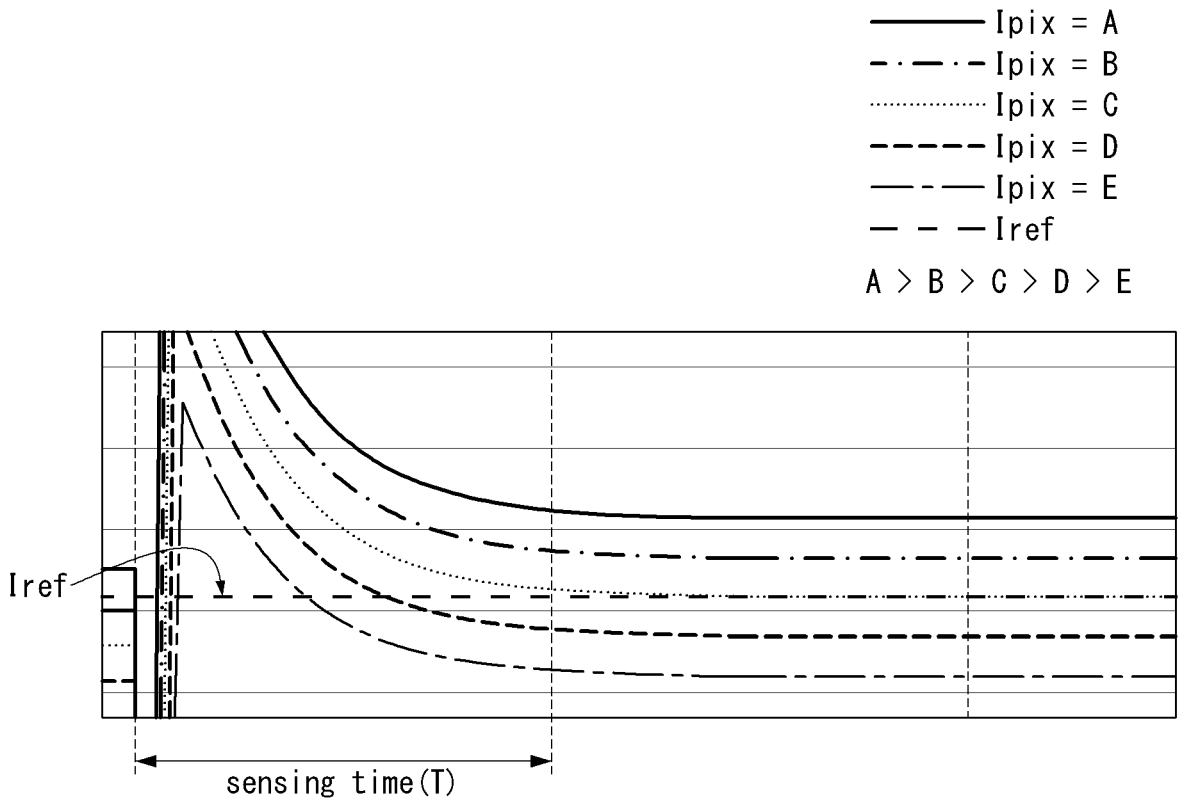
FIG. 16 is a view of a simulation waveform illustrating sensing results according to the sensing unit of FIG. 11.

FIG. 15 is a view of a simulation waveform illustrating sensing results according to the sensing unit of FIG. 8. FIG. 16 is a view of a simulation waveform illustrating sensing results according to the sensing unit of FIG. 11.

Referring to FIG. 15, in the sensing unit of FIG. 8, if the pixel current Vpix is not sufficiently smaller than the reference current Iref (Ipix=E), there is an interval in which the pixel voltage Vpix is greater than the reference voltage Vref for a predetermined time (e.g., T). This may cause a sensing error. To increase sensing resolution, a sensing time may be set to be 2T or longer. Reducing the sensing time to be shorter that that may degrade sensing resolution.

In contrast, referring to FIG. 16, in the case of the sensing unit of FIG. 11, even when the pixel current Ipix is not sufficiently smaller than the reference current Iref (Ipix=D, E), the pixel voltage Vpix is reduced to be comparable with the reference voltage Vref, and thus, a sensing error does not occur. Therefore, the sensing unit of FIG. 11 may ensure high sensing resolution, while reducing the sensing time by about half, compared with the sensing unit of FIG. 8.

As described above, in the present disclosure, since the sensing unit including a comparator without a feedback capacitor, rather than implementing a sensing unit with a current integrator having a feedback capacitor, is implemented, the problem that the sensing unit operates as a noise amplifier may be prevented in advance. Therefore, an introduction of noise is minimized, significantly increasing sensing performance and compensation performance.

Further, according to the present disclosure, the specific MOS transistor included in the sensing unit is diode-connected and is operated only in the saturation region and the voltage variation with respect to the current variation is controlled to be constant, thereby further improving resolution and accuracy of sensing.

Although embodiments have been described, it should be understood that other modifications may be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the specific embodiments.

The invention claimed is:

1. A current sensing device, comprising:

a sensing circuit selectively connected to a pixel and a reference current source through a sensing line, wherein the sensing circuit includes:

a plurality of resistors connected to a first node to set a divided voltage on the first node according to a pixel current input from the pixel and a reference current input from the reference current source;

a first MOS transistor connected between the first node and a second node;

a second MOS transistor diode-connected to the second node; and a comparator having an inverting input terminal connected to a third node and a non-inverting input terminal connected to a fourth node, the comparator configured to compare a reference voltage charged at the third node when the reference current is input and a pixel voltage charged at the fourth node when the pixel current is input, and configured to output a comparison result, wherein a gate electrode and a drain electrode of the second MOS transistor are connected to the second node, and a source electrode of the second MOS transistor is connected to a low potential voltage source.

2. The current sensing device of claim 1, wherein a gate-source voltage between the gate electrode and the source electrode of the second MOS transistor is equal to a drain-source voltage between the drain electrode and the source electrode of the second MOS transistor.

3. The current sensing device of claim 2, wherein the second MOS transistor operates only in a saturation region.

4. The current sensing device of claim 3, wherein a voltage variation with respect to a current variation is constant in an output waveform of the second MOS transistor representing a change in a drain-source current based on a change in the drain-source voltage.

5. The current sensing device of claim 1, wherein the plurality of resistors include:

a first resistor connected between the sensing line and the first node; and a second resistor connected between the first node and a bias voltage source.

6. The current sensing device of claim 1, wherein the sensing circuit further includes:

a reset switch connected between the second node and the third node and configured to turn on only when the reference current is input;

a sense switch connected between the second node and the fourth node and configured to turn on only when the pixel current is input; and a capacitor connected between the third node and the low potential voltage source.

7. The current sensing device of claim 1, wherein the sensing circuit further includes:

an operational amplifier having an inverting input terminal connected to the sensing line, a non-inverting input terminal connected to a bias voltage source, and an output terminal connected to a gate electrode of the first MOS transistor, and the operational amplifier configured to fix a voltage of the sensing line to a bias voltage.

8. The current sensing device of claim 1, wherein the first MOS transistor is a P type, and the second MOS transistor is an N type.

9. The current sensing device of claim 6, wherein the reset switch is also connected between a gate electrode of the second MOS transistor and the third node.

10. An organic light emitting display device, comprising:

a display panel including a pixel and a sensing line connected to the pixel;

current sensing circuitry having a sensing circuit selectively connected to the pixel and a reference current source through the sensing line, the sensing circuit including:

a plurality of resistors connected to a first node to set a divided voltage on the first node based on a pixel current input from the pixel and a reference current input from the reference current source;

a first MOS transistor connected between the first node and a second node;

a second MOS transistor diode-connected to the second node; and a comparator having an inverting input terminal connected to a third node and a non-inverting input terminal connected to a fourth node, the comparator configured to compare a reference voltage charged at the third node when the reference current is input and a pixel voltage charged at the fourth node when the pixel current is input, and configured to output a comparison result; and a timing controller configured to compensate for digital image data to be written into the display panel on the basis of the comparison result from the current sensing circuitry, wherein a gate electrode and a drain electrode of the second MOS transistor are connected to the second node, and a source electrode of the second MOS transistor is connected to a low potential voltage source.

11. The organic light emitting display device of claim 10, further comprising an integrated circuit including the reference current source embedded together with the current sensing circuitry in a data driver.

12. The organic light emitting display device of claim 10, wherein the reference current source is implemented through dummy pixels into which the digital image data is not written in the display panel.

13. The organic light emitting display device of claim 12, wherein in a pixel array of the display panel, a dummy pixel block including the dummy pixels is positioned closer to a data driver than a pixel block including the pixel.

14. The organic light emitting display device of claim 12, wherein the dummy pixels only serve to generate the reference current.

* * * * *